US012668883B2

(12) United States Patent
Takajo et al.

(10) Patent No.: US 12,668,883 B2
(45) Date of Patent: Jun. 30, 2026

(54) METHOD FOR FORMING GROOVE ON METAL STRIP SURFACE AND METHOD FOR MANUFACTURING GRAIN-ORIENTED ELECTRICAL STEEL SHEET

(71) Applicant: JFE STEEL CORPORATION, Tokyo (JP)

(72) Inventors: Shigehiro Takajo, Tokyo (JP); Takeshi Omura, Tokyo (JP); Nobuko Nakagawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 600 days.

(21) Appl. No.: 18/246,183

(22) PCT Filed: Jul. 2, 2021

(86) PCT No.: PCT/JP2021/025196
§ 371 (c)(1),
(2) Date: Mar. 22, 2023

(87) PCT Pub. No.: WO2022/074882
PCT Pub. Date: Apr. 14, 2022

(65) Prior Publication Data

US 2023/0366101 A1 Nov. 16, 2023

(30) Foreign Application Priority Data

Oct. 6, 2020 (JP) ..... 2020-169441

(51) Int. Cl.
*C23F 4/02* (2006.01)
*C21D 8/1216* (2026.01)
*C21D 8/1244* (2026.01)

(52) U.S. Cl.
CPC ..... *C23F 4/02* (2013.01); *C21D 8/1222* (2013.01); *C21D 8/1233* (2013.01);
(Continued)

(58) Field of Classification Search
CPC ..... C23F 4/02; C23F 1/02; C25F 3/06; C25F 3/14; C21D 8/1222; C21D 8/1233;
(Continued)

(56) References Cited

U.S. PATENT DOCUMENTS 11,045,902 B2 6/2021 Takajo et al.
2008/0044766 A1 2/2008 Kwon et al.
(Continued)

FOREIGN PATENT DOCUMENTS

CN 101528951 A 9/2009
CN 107849631 A 3/2018
(Continued)

OTHER PUBLICATIONS

Prezeau Tony et.al. [WO2015044591A1] (machine translation). (Year: 2015).*
(Continued)

*Primary Examiner* — Sally A Merkling
*Assistant Examiner* — Nazmun Nahar Shams
(74) *Attorney, Agent, or Firm* — KENJA IP LAW PC

(57) ABSTRACT

A grain-oriented electrical steel sheet with extremely excellent magnetic properties by removing an etching resist coating well to form narrow grooves on a metal strip surface even with low-output laser, while reducing thermal effects on the metal strip caused by laser irradiation, and a method for forming grooves on a metal strip surface, having forming an etching resist coating with 0 to 70 lightness L* on at least one side of the metal strip, irradiating laser with less than 1.5 kW output on the etching resist coating while scanning the laser in a direction that intersects a rolling direction of the metal strip to remove a portion of the etching resist coating irradiated by the laser, and etching a portion of the metal strip below the removed portion of the etching resist coating
(Continued)

to form grooves, the lightness L* being a L* value in a CIELAB color space (CIE1976L*a*b* color space).

20 Claims, 5 Drawing Sheets

(52) U.S. Cl.
CPC ..... *C21D 8/1261* (2013.01); *C21D 8/1272* (2013.01); *C21D 2201/05* (2013.01)

(58) Field of Classification Search
CPC ..... C21D 8/1261; C21D 8/1272; C21D 2201/05; C21D 6/008; C21D 8/1277; C21D 8/1294; B23K 26/364; B23K 26/362; H01F 1/16; H01F 41/0233; H01F 1/147; C22C 38/02; C22C 38/06
See application file for complete search history.

(56) References Cited

U.S. PATENT DOCUMENTS

| | | | | |
|---|---|---|---|---|
| 2009/0272464 | A1 | 11/2009 | Hamamura et al. | |
| 2012/0121749 | A1 | 5/2012 | Sakai et al. | |
| 2012/0171467 | A1* | 7/2012 | Takeda | C09D 7/68 428/327 |
| 2013/0139932 | A1 | 6/2013 | Sakai et al. | |
| 2018/0017868 | A1 | 1/2018 | Suehiro et al. | |
| 2018/0043474 | A1* | 2/2018 | Hamamura | C21D 8/1255 |
| 2018/0119242 | A1 | 5/2018 | Kobayashi | |
| 2018/0147663 | A1* | 5/2018 | Takajo | C23F 1/28 |
| 2018/0281016 | A1 | 10/2018 | Goto et al. | |
| 2021/0027922 | A1 | 1/2021 | Yasuda et al. | |

FOREIGN PATENT DOCUMENTS

| | | | | |
|---|---|---|---|---|
| CN | 111655886 | A | 9/2020 | |
| JP | S61238918 | A | 10/1986 | |
| JP | 2008015530 | A | 1/2008 | |
| JP | 2015071815 | A | 4/2015 | |
| JP | 2017025377 | A | 2/2017 | |
| JP | 6172403 | B2 | 8/2017 | |
| JP | 6332185 | B2 | 5/2018 | |
| JP | 2020090709 | A | 6/2020 | |
| WO | WO-2015044591 | A1 * | 4/2015 | G01N 21/8422 |
| WO | 2016129235 | A1 | 8/2016 | |

OTHER PUBLICATIONS

Sep. 21, 2021, International Search Report issued in the International Patent Application No. PCT/JP2021/025196.
Feb. 13, 2025, Office Action issued by the Korean Intellectual Property Office in the corresponding Korean Patent Application No. 10-2023-7010983 with English language concise statement of relevance.
Jan. 26, 2025, Office Action issued by the China National Intellectual Property Administration in the corresponding Chinese Patent Application No. 202180067710.4 with English language search report.
Mar. 27, 2024, the Extended European Search Report issued by the European Patent Office in the corresponding European Patent Application No. 21877186.3.

* cited by examiner

METHOD FOR FORMING GROOVE ON METAL STRIP SURFACE AND METHOD FOR MANUFACTURING GRAIN-ORIENTED ELECTRICAL STEEL SHEET

TECHNICAL FIELD

This disclosure relates to a method for forming grooves on a surface of a metal strip such as grain-oriented electrical steel sheet used for iron cores of electrical equipment such as transformers, and to a method for manufacturing a grain-oriented electrical steel sheet by using the method for forming grooves.

BACKGROUND

Grain-oriented electrical steel sheets are mainly used as materials for iron cores inside transformers. In order to improve the energy usage efficiency of transformers, there is a demand for reducing iron loss in grain-oriented electrical steel sheets. One technique to reduce iron loss in grain-oriented electrical steel sheets is to refine the magnetic domain structure by forming grooves and other irregular portions on the steel sheet surface. Known methods for forming grooves on the steel sheet surface include pressing a gear-shaped roller against the steel sheet surface, using a laser beam to locally melt the steel substrate of the steel sheet, and using etching resist coating and etching an etching resist-unapplied portion of the steel sheet surface by chemical etching or electrolytic etching to thereby form grooves on the etching resist-unapplied portion. Among these methods, the method using the etching resist coating is advantageous for efficiently forming deep grooves and has the advantage of high magnetic domain refining effect. However, in the method using the etching resist coating, as in other methods, it is extremely important to form grooves with high accuracy and uniformity.

Among the methods for forming grooves using the etching resist coating, as especially industrially advantageous one, there is a technique for locally removing a portion of the etching resist coating uniformly applied to the steel sheet surface by a laser beam and etching a portion of the steel sheet surface below the removed portion of the etching resist coating by chemical etching or electrolytic etching to thereby form grooves (JP6332185B (PTL 1)). Because under properly maintained conditions, the laser beam retains very uniform beam properties, very uniform grooves can be formed. On the other hand, as we have clarified in our previous research, in this method, the laser irradiated to remove the etching resist coating causes distortion and melting of the steel substrate, which may damage the magnetic properties of the steel sheet as a finished product. In contrast, JP6172403B (PTL 2) discloses a technique for removing the etching resist coating in a short time by using a high-output laser (with an output of 1.5 kW or more) to suppress thermal diffusion in the steel substrate during irradiation and obtain high magnetic properties.

CITATION LIST

Patent Literature

PTL 1: JP6332185B

PTL 2: JP6172403B

SUMMARY

Technical Problem

By the way, it is known that the magnetic properties of a grain-oriented electrical steel sheet whose magnetic domains are refined by groove become good as the groove width becomes narrower. In the method where a portion of the uniformly applied etching resist coating is locally removed by a laser beam, it is most effective to reduce the diameter of the beam for removing the etching resist coating in order to form narrow grooves. However, since the beam diameter tends to increase with higher output, it is difficult to reduce the width of the formed groove to 200 μm or less in the technique disclosed PTL 2. While measures such as increasing the number of lasers installed and removing the etching resist coating by scanning low-output lasers over the steel sheet at a slower speed are effective, they are not free from other problems such as increased equipment and maintenance costs. That is, for further groove width reduction, the resist coating must be removed even with low-output lasers to the same degree as the conventionally used high-output lasers.

In addition, as a result of our own investigation, we found that the iron loss of the finally obtained grain-oriented electrical steel sheet deteriorates when the hardness of the steel substrate is reduced by the laser irradiated for the removal of the etching resist coating. Therefore, we believed that the magnetic properties could be further improved by reducing thermal effects of laser irradiation on the metal strip, including the reduction in the hardness of the steel substrate.

It could thus be helpful to provide a grain-oriented electrical steel sheet with extremely excellent magnetic properties by removing the etching resist coating well to form narrow grooves on the metal strip surface even with a low-output laser, while reducing the thermal effects on the metal strip caused by laser irradiation.

Solution to Problem

We thus provide the following.

[1] A method for forming grooves on a surface of a metal strip, comprising forming an etching resist coating with a lightness L* of 0 or more and 70 or less on at least one side of the metal strip, then, irradiating a laser with an output of less than 1.5 kW on the etching resist coating while scanning the laser in a direction that intersects a rolling direction of the metal strip to remove a portion of the etching resist coating irradiated by the laser, and then, etching a portion of the metal strip below the removed portion of the etching resist coating to form grooves, wherein the lightness L* is a L* value in a CIELAB color space (CIE 1976 L*a*b* color space).

[2] The method for forming grooves on a surface of a metal strip according to [1], wherein a removal width of the etching resist coating is 200 μm or less and a scanning rate of the laser is 111 m/s or more.

[3] The method for forming grooves on a surface of a metal strip according to [1] or [2], wherein a beam diameter in a direction orthogonal to a scanning direction of the laser on the surface of the metal strip is 200 μm or less.

[4] The method for forming grooves on a surface of a metal strip according to any of [1] to [3], wherein the laser is a fiber laser whose beam diameter in a direction orthogonal to a scanning direction of the laser is 200 μm or less.

[5] The method for forming grooves on a surface of a metal strip according to any of [1] to [4], wherein a surface roughness Ra of the metal strip in a transverse direction before the etching resist coating is formed is 0.5 μm or less.

[6] A method for manufacturing a grain-oriented electrical steel sheet, comprising hot rolling a steel slab into a hot-rolled steel sheet, then, subjecting the hot-rolled steel sheet or a hot-rolled and annealed sheet obtained by applying hot-rolled sheet annealing to the hot-rolled steel sheet to cold rolling once, or twice or more with intermediate annealing performed therebetween to obtain a cold-rolled steel sheet, then subjecting the cold-rolled steel sheet to primary recrystallization annealing to obtain a primary recrystallized sheet, and then, subjecting the primary recrystallized sheet to secondary recrystallization annealing to obtain a secondary recrystallized sheet, wherein grooves are formed on a surface of the steel sheet at any stage after being subjected to hot rolling by the method for forming grooves according to any of [1] to [5].

Advantageous Effect

According to this disclosure, the etching resist coating can be removed well to form narrow grooves on the metal strip surface even with a low-output laser, while reducing the thermal effects on the metal strip caused by laser irradiation, and thus a grain-oriented electrical steel sheet with extremely excellent magnetic properties can be provided.

DETAILED DESCRIPTION

Figure 1:
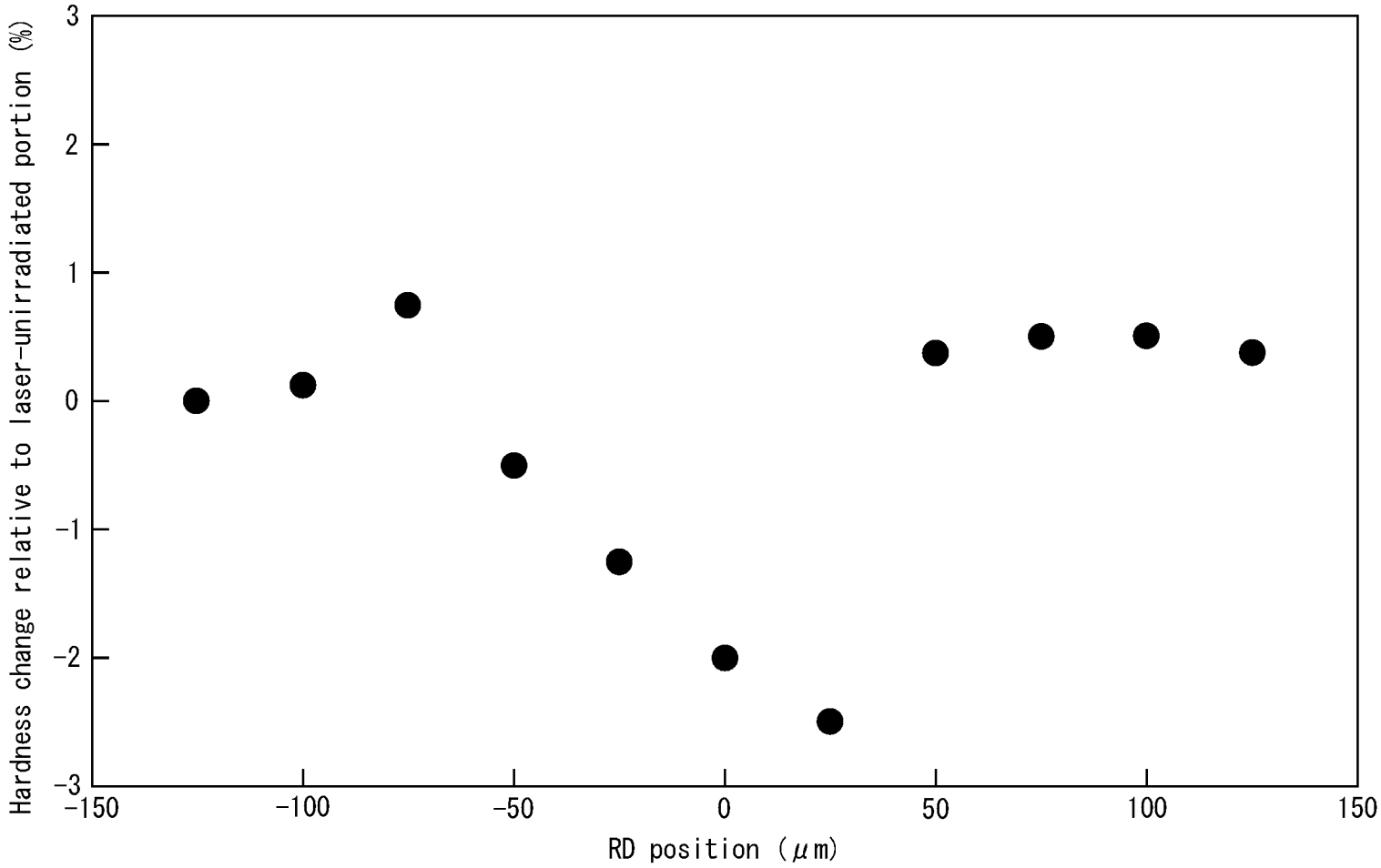
FIG. 1 illustrates the results of examining the hardness distribution of the steel sheet steel substrate near the laser-irradiated portion under conditions where high magnetic properties could not be obtained.

First, we describe the experiments that led to the development of this disclosure. In the following description, the "%" and "ppm" representations indicating the chemical composition of the steel sheet mean "mass %" and "mass ppm" unless stated otherwise. In the present specification, a numerical range expressed by using "to" means a range including numerical values described before and after "to", as the lower limit value and the upper limit value.

Experiment 1

We considered changing the requirements for the etching resist coating. Then, various types of etching resist coatings were formed on steel sheet surfaces and linear grooves were formed on the steel sheet surfaces to compare the magnetic flux densities obtained. First, cold-rolled steel sheets (C: 0.048%, Mn: 0.07%, P: 0.007%, S: 0.002%, Al: 0.010%, N: 50 ppm, Ti+Nb+V+Zr+Ta<0.001%) with a width of 500 mm were prepared to form linear grooves. A steel slab having the chemical composition described above was hot rolled into hot-rolled steel sheets, then the hot-rolled steel sheets were subjected to hot-rolled sheet annealing at 1050° C. to obtain hot-rolled and annealed sheets, and the hot-rolled and annealed sheets were cold rolled at 300° C. or lower into cold-rolled steel sheets with a thickness of 0.22 mm. On the surface of each of the cold-rolled steel sheets, a coating agent for etching resist coating formation was uniformly applied with a gravure roll to form an etching resist coating. For the coating agent for etching resist coating formation, one having a water-based alkyd resin as the main component, with a modified composition of black and white pigments was used. Next, the etching resist coating was locally removed by irradiating a high-output laser while scanning the laser in a direction orthogonal to the rolling direction (RD) (transverse direction: TD) of the cold-rolled steel sheet. The cold-rolled steel sheet was then subjected to an etching process and a portion of the steel sheet surface below a portion of the etching resist coating removed by the laser (hereinafter referred to as the laser removal portion) was etched to form linear grooves on the surface of the cold-rolled steel sheet. The etching resist coating remaining on the cold-rolled steel sheet was then completely removed. The cold-rolled steel sheet with linear grooves was then subjected to primary recrystallization annealing, which also served as decarburization annealing, at 860° C. to make a primary recrystallized sheet and was further subjected to secondary recrystallization annealing at a maximum temperature of 1200° C. to make a secondary recrystallized sheet. The secondary recrystallized sheet was then annealed at a maximum arrival temperature of 860° C. to flatten the sheet and form an insulating tension coating, resulting a grain-oriented electrical steel sheet with a sheet thickness of 0.22 mm. Iron loss properties were evaluated for the grain-oriented electrical steel sheet with linear grooves produced in this manner. For iron loss, a single sheet magnetic test was conducted using 30 SST test pieces with a width of 100 mm and a length of 320 mm, and iron loss: $W_{17/50}$ (W/kg) was measured at a maximum magnetic flux density: 1.7 T and frequency: 50 kHz. As a result, we found that high magnetic properties may not be obtained depending on the type of etching resist coating.

Forming an etching resist coating and laser irradiation were conducted anew under conditions where high magnetic properties could not be obtained to examine the hardness distribution on the steel substrate of the steel sheet surface near the laser-irradiated portion. FIG. 1 illustrates the results. The RD position in the figure indicates the position in the rolling direction (RD) at the center portion of the steel sheet in the width direction, with the center of laser irradiation on the steel sheet used as the origin. The laser was irradiated onto the steel sheet by a single laser irradiation device with a diameter of 80 μm and an output of 1.8 kW. The hardness of the steel substrate was measured after the etching resist coating was removed without etching from the cold-rolled steel sheet that had been coated with the etching resist coating as described above. To measure the hardness of the steel substrate, the micro-Vickers hardness meter was used and each point in the figure is the average of 15 measurement points. The hardness criterion was the value at 1 mm away from the laser-irradiated portion in the rolling direction (RD) (laser-unirradiated portion) and at each measurement point, the percentage change in the hardness of the steel substrate relative to the hardness value at the laser-unirradiated portion was investigated. According to the figure, the hardness of the steel sheet surface of the laser-irradiated portion was clearly reduced compared to the laser-unirradiated portion, and this reduction in hardness was considered to have some effect on the degradation of the magnetic properties of the grain-oriented electrical steel sheet.

Experiment 2

We changed the type of etching resist coating and intensively investigated the relationship between the type of etching resist coating and the magnetic properties (iron loss $W_{17/50}$) of the finally obtained grain-oriented electrical steel sheet. First, cold-rolled steel sheets (C: 0.048%, Mn: 0.07%, P: 0.007%, S: 0.002%, Al: 0.010%, N: 50 ppm, Ti+Nb+V+Zr+Ta<0.001%) with a width of 500 mm were prepared to form linear grooves. A steel slab having the chemical composition described above was subjected to hot rolling to obtain hot-rolled steel sheets, then the hot-rolled steel sheets were subjected to hot-rolled sheet annealing at 1050° C. to obtain hot-rolled and annealed sheets, and the hot-rolled and annealed sheets were cold rolled into cold-rolled steel sheets. Linear grooves were formed on the cold-rolled steel sheets under the conditions described below and the cold-rolled steel sheets were then subjected to primary recrystallization annealing at 860° C. to make primary recrystallized sheets, and the primary recrystallized sheets were subjected to secondary recrystallization annealing at a maximum temperature of 1200° C. to make secondary recrystallized sheets. The secondary recrystallized sheets were then annealed at a maximum arrival temperature of 860° C. to flatten the sheets and form an insulating tension coating, resulting grain-oriented electrical steel sheets with a sheet thickness of 0.22 mm.

In forming the linear grooves, on the surface of each of the grain-oriented electrical steel sheets, a coating agent for etching resist coating formation was uniformly applied to form an etching resist coating. In this process, for the coating agent for etching resist coating formation, one having a water-based alkyd resin as the main component, with a modified composition of black and white pigments was used to obtain a plurality of grain-oriented electrical steel sheets with etching resist coatings of different compositions.

Next, a laser beam was irradiated while being scanned on each of the grain-oriented electrical steel sheets after etching resist coating formation in the transverse direction (TD) to locally remove the etching resist coating. The steel sheet surface under the laser removal portion was then etched to form linear grooves on the surface of the grain-oriented electrical steel sheet. The etching resist coating remaining on the steel sheet surface was then removed. The surface roughness Ra of the grain-oriented electrical steel sheet coated with the coating agent for etching resist coating formation was 0.1 μm in the transverse direction (TD). The laser to remove the etching resist coating was irradiated by a single laser irradiation device with a diameter of 120 μm. The laser output was determined for each type of etching resist coating by prior testing. In detail, the laser was irradiated while increasing the laser output by 100 W, the appearance of the laser-irradiated portion was visually judged, and the lowest laser output among the conditions in which the etching resist coating was removed at an area ratio of 95% or more of the laser-irradiated area was set as the laser output required to remove the etching resist coating agent. The irradiation was performed at this output. Here, the laser-irradiated area was obtained by multiplying the diameter of the beam in a direction orthogonal to the scanning direction by the distance the laser was scanned.

For the grain-oriented electrical steel sheet after flattening and insulating tension film formation, a single sheet magnetic test was conducted using 3 SST test pieces with a width of 100 mm and a length of 320 mm to measure iron loss: $W_{17/50}$ (W/kg) at a maximum magnetic flux density: 1.7 T and frequency: 50 kHz.

Figure 2:
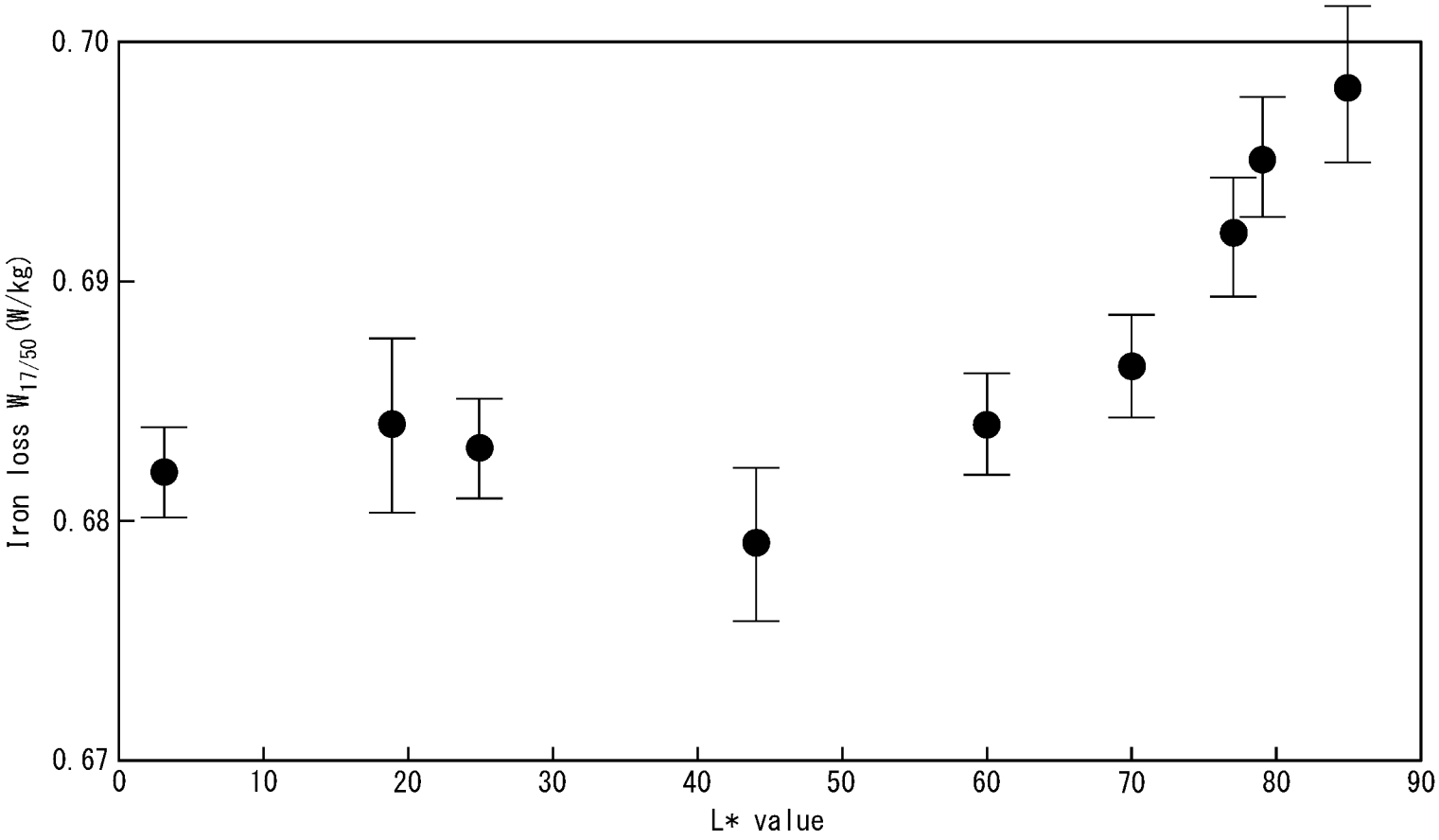
FIG. 2 illustrates the correlation between the lightness L* of the etching resist coating and the iron loss $W_{17/50}$ of the grain-oriented electrical steel sheet.

We found the correlation illustrated in FIG. 2 between the lightness L* value (hereinafter also referred to simply as L* value) of the etching resist coating in the CIELAB color space (CIE 1976 L*a*b* color space), which is quantified by spectral reflectance measured with a spectrophotometer, and the magnetic properties of the grain-oriented electrical steel sheet. As illustrated in FIG. 2, this experiment revealed that the iron loss $W_{17/50}$ of the grain-oriented electrical steel sheet after groove formation is significantly reduced when the L* value of the etching resist coating is 70 or less.

Figure 3:
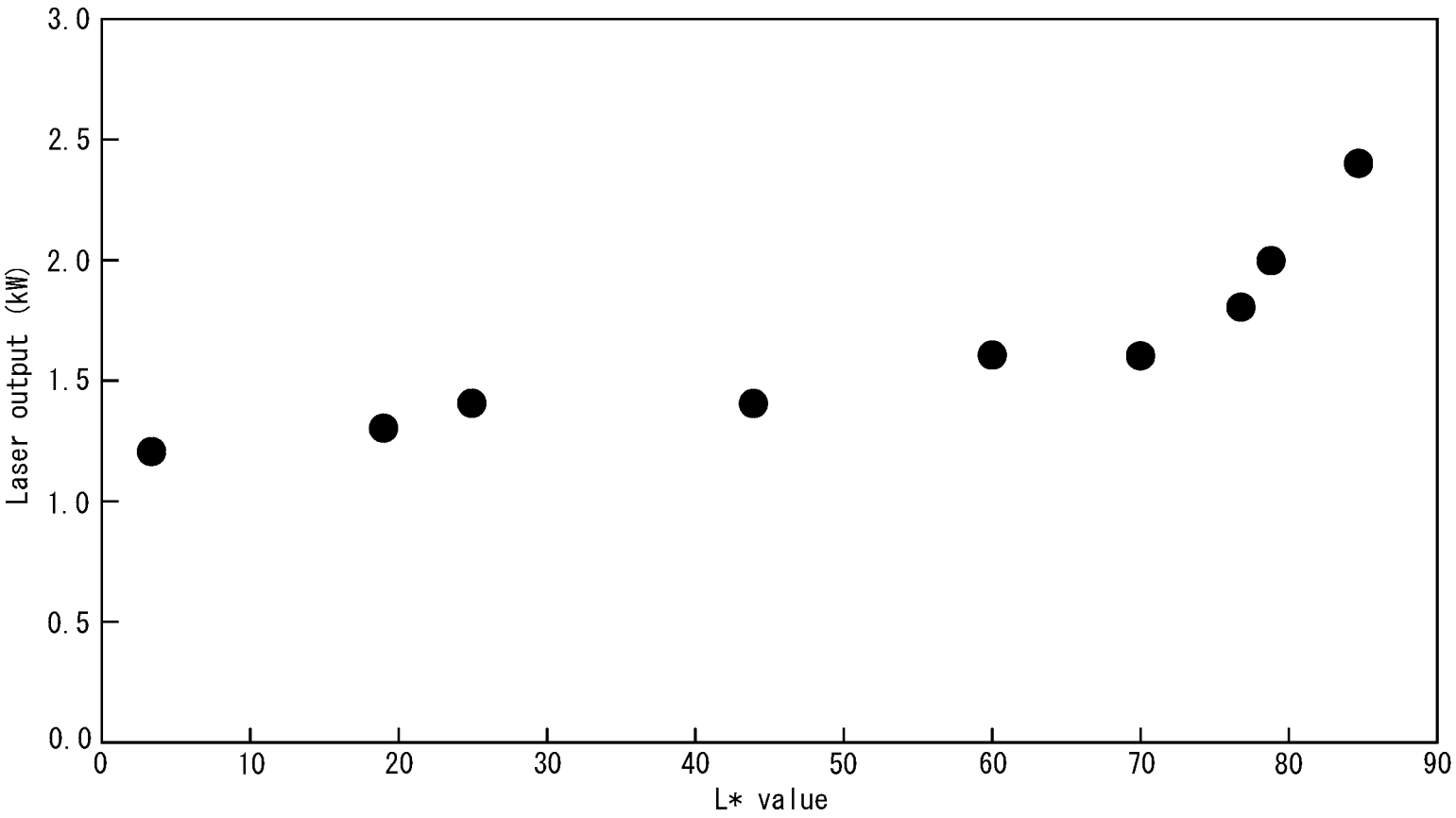
FIG. 3 illustrates the correlation between the lightness L* of the etching resist coating and the laser output required to remove the etching resist coating.

FIG. 3 illustrates the correlation between the lightness L* of the etching resist coating and the laser output required to remove the etching resist coating as determined above. We found that the laser output required to remove the etching resist coating decreases as the L* value is lower, as illustrated in FIG. 3. Further, we found that when the L* value of the etching resist coating is less than 70, the etching resist coating can be removed without necessarily using a laser with high-output conditions. In detail, when the etching resist coating can be removed by a low-output laser, the beam diameter can be reduced to form narrow grooves, which in turn makes it possible to improve the magnetic properties of the grain-oriented electrical steel sheet.

Experiment 3

Figure 4:
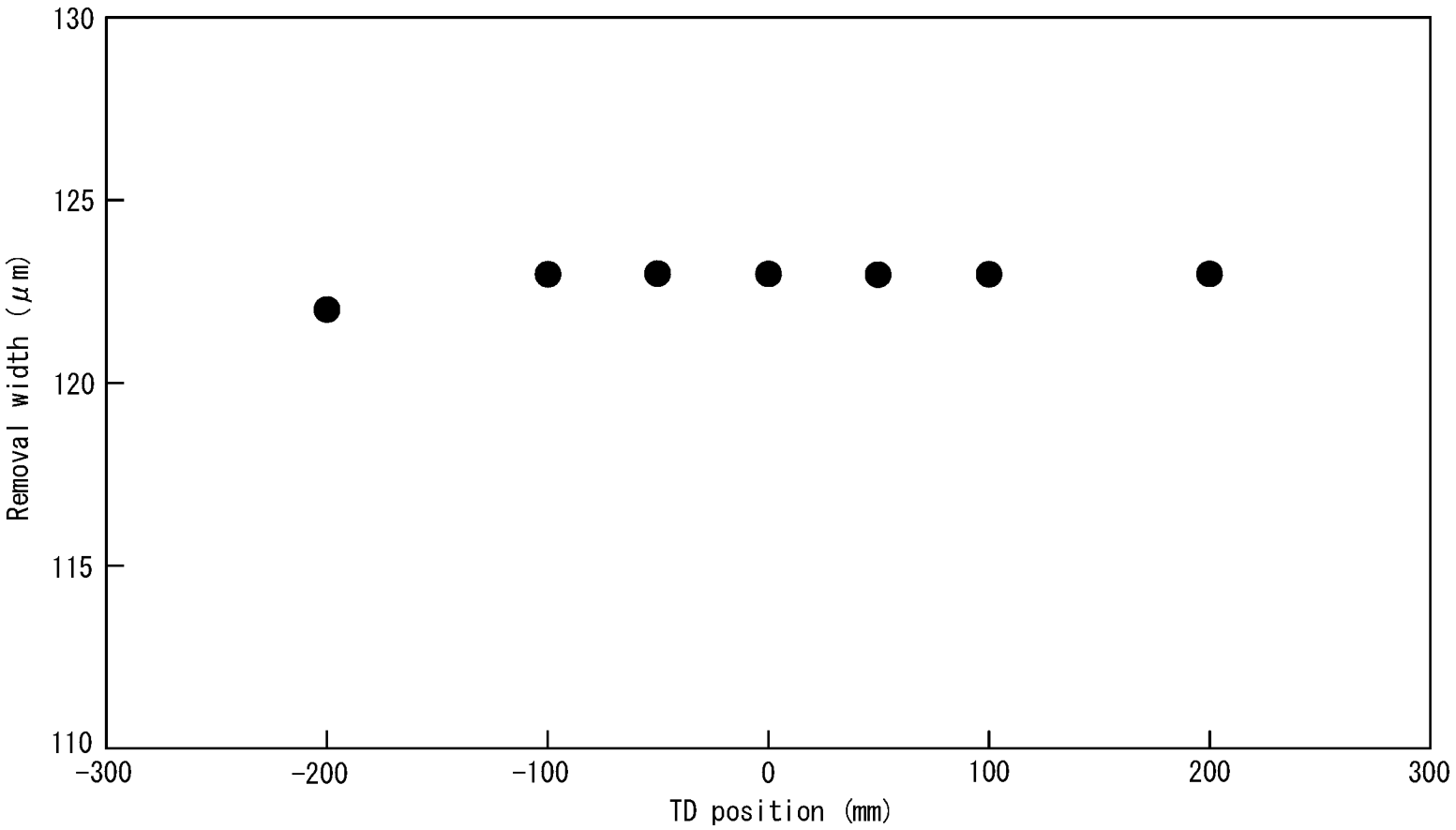
FIG. 4 illustrates the removal width distribution of etching resist coating in the transverse direction (direction orthogonal to the rolling direction, TD) when the lightness L* of the etching resist coating is 44.

The removal width distribution of the etching resist coating in the transverse direction (TD) in the case of L*=44 in Experiment 2 described above was determined. FIG. 4 illustrates the results. It can be seen from FIG. 4 that by lowering the L* value, the removal width at the laser-irradiated edge is not significantly reduced and the etching resist coating can be removed uniformly. The removal width of the etching resist coating was examined by observation with an optical microscopy at each position in the transverse direction (TD).

Experiment 4

Furthermore, we increased the surface roughness Ra of the grain-oriented electrical steel sheet before etching resist coating formation, changed the type of etching resist coating, and investigated their effects on iron loss. First, cold-rolled steel sheets (C: 0.043%, Mn: 0.07%, P: 0.002%, S: 0.001%, Al: 0.009%, N: 45 ppm, Ti+Nb+V+Zr+Ta<0.001%) with a width of 500 mm were prepared to form linear grooves. A steel slab having the chemical composition described above was hot rolled into hot-rolled steel sheets, then the hot-rolled steel sheets were subjected to hot-rolled sheet annealing at 1050° C. to obtain hot-rolled and annealed sheets, and the hot-rolled and annealed sheets were cold rolled into cold-rolled steel sheets. Linear grooves were formed on the cold-rolled steel sheets and the cold-rolled steel sheets were then subjected to primary recrystallization annealing at 860° C. to make primary recrystallized sheets, and the primary recrystallized sheets were subjected to secondary recrystallization annealing at a maximum temperature of 1200° C. to make secondary recrystallized sheets. The secondary recrystallized sheets were then annealed at a maximum arrival temperature of 860° C. to flatten the sheets and form an insulating tension coating, resulting grain-oriented electrical steel sheets with a sheet thickness of 0.22 mm.

In forming the linear grooves, on the surface of each of the grain-oriented electrical steel sheets, a coating agent for etching resist coating formation was uniformly applied to form an etching resist coating. For the coating agent for etching resist coating formation, one having a water-based alkyd resin as the main component, with a modified composition of black and white pigments was used as in Experiment 2 to obtain a plurality of grain-oriented electrical steel sheets with etching resist coatings of different compositions. As in Experiment 2, a laser was irradiated in the transverse direction (TD) on each of the grain-oriented electrical steel sheets after etching resist coating formation, and the steel sheet surface under the laser removal portion was etched to form linear grooves on the grain-oriented electrical steel sheet surface, and the etching resist coating remaining on the steel sheet was removed. The surface roughness Ra of the grain-oriented electrical steel sheet coated with the coating agent for etching resist coating formation was 0.55 μm in the transverse direction (TD). The laser to remove the etching resist coating was irradiated by a single laser irradiation device with a diameter of 120 μm. The laser output was the same as in Experiment 2, corresponding to the etching resist coating of each lightness.

Figure 5:
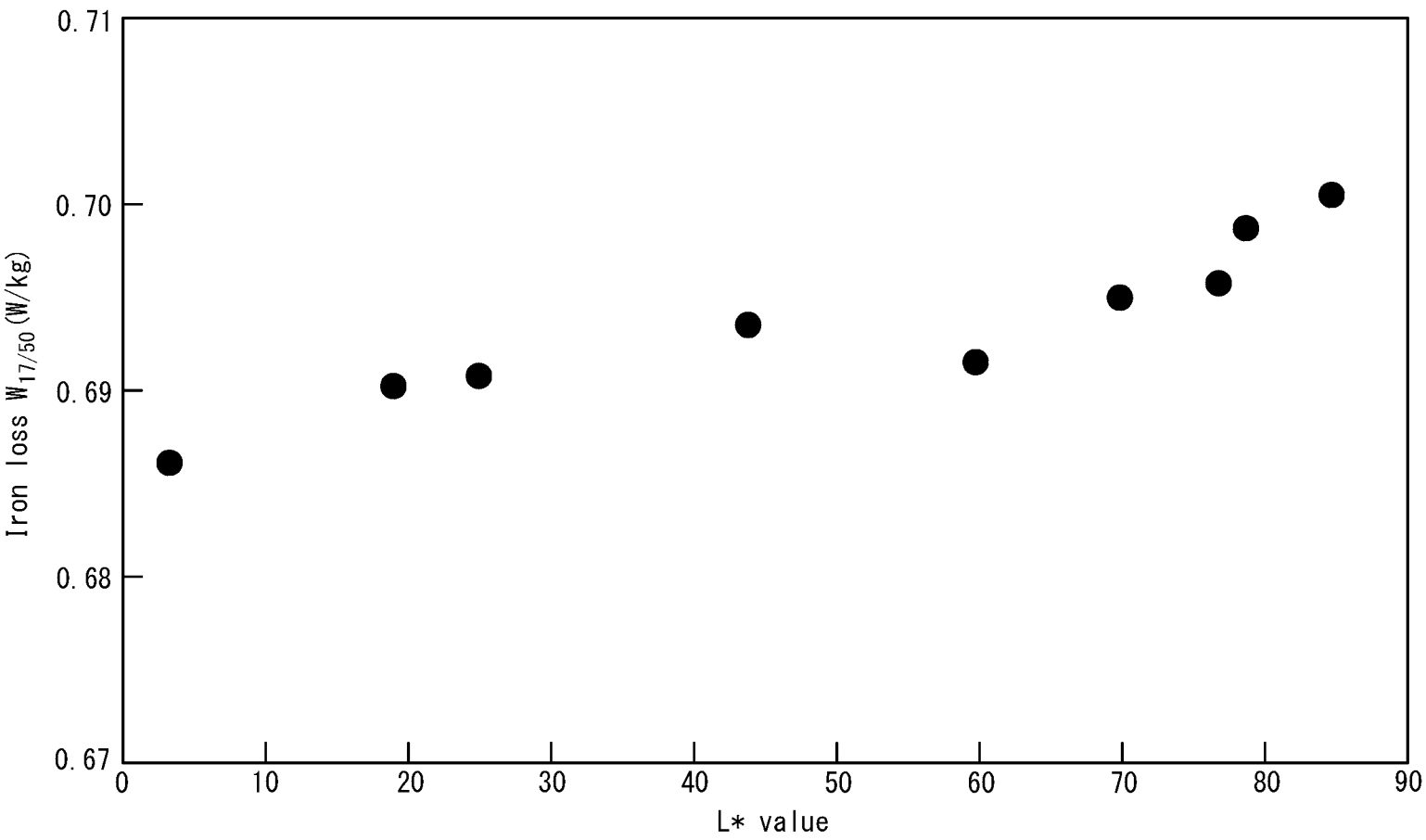
FIG. 5 illustrates the correlation between the lightness L* of the etching resist coating and the iron loss $W_{17/50}$ of the grain-oriented electrical steel sheet when the surface roughness Ra in the transverse direction (TD) of the steel sheet before the etching resist coating is formed exceeds 0.5 μm.

For iron loss of the grain-oriented electrical steel sheet after flattening and insulating tension film formation, a single sheet magnetic test was conducted using 3 SST test pieces with a width of 100 mm and a length of 320 mm to measure iron loss: $W_{17/50}$ (W/kg) at a maximum magnetic flux density: 1.7 T and frequency: 50 kHz. FIG. 5 illustrates the results.

We found that when the surface roughness Ra of the grain-oriented electrical steel sheet before etching resist coating formation is large, the iron loss may not be lowered even if the L* value of the etching resist coating is low. FIG. 5 illustrates the relationship between the L* value of the etching resist coating and the iron loss $W_{17/50}$ of the grain-oriented electrical steel sheet after groove formation, obtained when the surface roughness Ra of the grain-oriented electrical steel sheet before etching resist coating formation was 0.55 μm in the transverse direction. Comparison with FIG. 2 reveals that when the surface roughness Ra of the grain-oriented electrical steel sheet before etching resist coating formation is 0.55 μm in the transverse direction, the effect of iron loss reduction is smaller even when L* is 70 or less, compared to the case where the surface roughness Ra is 0.1 μm.

The following describes an embodiment of the present disclosure. The present disclosure is not limited to the following embodiment. The method for forming grooves according to the embodiment comprises forming an etching resist coating on at least one side of a metal strip, then, irradiating a laser with an output of less than 1.5 kW on the etching resist coating while scanning the laser in a direction that intersects a rolling direction of the metal strip to remove a portion of the etching resist coating in a portion irradiated by the laser, and then, etching a portion of the metal strip below the removed portion of the etching resist coating to form grooves, wherein the etching resist coating has a lightness L* in the CIELAB color space of 0 or more and 70 or less.

Etching Resist Coating and Coating Agent for Etching Resist Coating Formation

First, an etching resist coating is formed on at least one side of a metal strip. The etching resist coating is formed to prevent corrosion of the metal strip surface during the etching process. It is an extremely important feature of the present disclosure that the L* value be set to 0 or more and 70 or less in the CIELAB color space (CIE 1976 L*a*b* color space), in which the color tone of the etching resist coating is quantified by spectral reflectance measured with a spectrophotometer. As described above, by reducing the L* value, narrow grooves can be formed on the metal strip surface even with a low-output laser, while reducing the thermal effects on the metal strip caused by laser irradiation, and thus a grain-oriented electrical steel sheet with extremely excellent magnetic properties can be provided. The lightness L* of the etching resist coating is preferably 65 or less and more preferably 60 or less. The lower limit of the lightness L* of the etching resist coating is not limited, as long as it is 0 or more.

Two types of etching resist coating with the lightness L* of 79 or 44 were formed, and whether the steel substrate hardness in the laser-scanned portion of the steel sheet after laser removal of the etching resist coating was reduced by 1% or more compared to the hardness value in the laser-unirradiated portion was investigated. The results are provided in Table 1. The etching resist coating was formed on cold-rolled steel sheets with a width of 500 mm (C: 0.042%, Mn: 0.14%, P: 0.003%, S: 0.002%, Al: 0.11%, N: 54 ppm, Ti+Nb+V+Zr+Ta<0.001%). The cold-rolled steel sheets were obtained by hot rolling a steel slab into hot-rolled steel sheets, subjecting the hot-rolled steel sheets to hot-rolled sheet annealing at 1050° C. to obtain hot-rolled and annealed sheets, and then cold rolling the hot-rolled and annealed sheets into cold-rolled steel sheets. The laser had a diameter of 200 μm on each of the steel sheets and irradiated while being scanned in the 500 mm width direction of the steel sheet. Here, the laser output was adjusted in advance so that the etching resist coating was removed 95% or more of the laser-irradiated area over the entire width of the laser-scanned portion. The positions in the table indicate the position in the laser scanning direction, with the center portion of the steel sheet in the width direction where the laser was scanned used as origin. The hardness of the steel sheet was measured at the origin and at laser-scanned portions ±50, ±100, ±150, and ±245 mm away from the origin. The micro-Vickers hardness meter was used to measure the hardness of the steel substrate, and the hardness at each position was the average of 15 measurement points. The hardness criterion was the value at 1 mm away from the laser-irradiated portion in the rolling direction (RD) (laser-unirradiated portion), and whether the steel substrate hardness at each measurement point was reduced by 1% or more relative to the hardness value in the laser-unirradiated portion was investigated. Under the above two conditions, the distribution of hardness change relative to the laser-unirradiated portion as illustrated in FIG. 1 was measured at each position in the rolling direction. As a result, a hardness change of 1% or more was observed only at the center part position in the width direction (laser-irradiated portion) where L*=79, and the hardness change was less than 1% at other positions.

TABLE 1

| Position (mm) | L* 79 | L* 44 |
|---|---|---|
| ±245 | absent | absent |
| ±150 | absent | absent |
| ±100 | absent | absent |
| ±50 | absent | absent |
| 0 | present | absent |

Underlined if outside the scope of the disclosure.

As listed in Table 1, when the lightness L* of the etching resist coating was 44, the steel substrate hardness did not decrease by 1% or more from the hardness value in the laser-unirradiated portion at any position in the laser scanning direction. In contrast, when the lightness L* of the etching resist coating was 79, steel substrate hardness decreased by 1% or more from the hardness value in the laser-unirradiated portion at the center portion of the steel sheet in the width direction (origin: position 0 mm). Under the condition with high L* value, an attempt was made to remove the etching resist coating using a low-output laser of 1.5 W or less, but the etching resist coating was not completely removed at the width direction position of 245 mm. A high laser output of 1.8 kW was required to remove the etching resist coating at full width. In contrast, under the low L* value condition, the etching resist coating was removed over the entire width with a laser output of 1.0 kW. Although the detailed cause is unknown, it is assumed that when the L* value of the etching resist coating is high, the laser absorption capacity of the etching resist coating decreases, especially at the laser beam deflection edge in the laser scanning direction, and thus a higher-output laser is required.

An etching resist coating (organic) having any of alkyd resin, epoxy resin, and polyethylene resin as main component is preferable but other etching resist coatings can be used. For example, an inorganic coating that serves as a tension coating on a grain-oriented electrical steel sheet may be used as etching resist coating. The thickness of the etching resist coating is generally 0.1 μm or more and 8 μm or less. Since an excessively thick etching resist coating leads to increased costs, the thickness of the etching resist coating should be as small as possible within the range where the coating agent for etching resist coating formation can be applied uniformly, and etching can be performed normally.

The lightness L* value of the etching resist coating can be adjusted by adjusting the mix proportion of the pigment component in the coating agent for etching resist coating formation. For example, it is possible to adjust the lightness L* value of the etching resist coating by adjusting an amount of at least one of white pigment and black pigment in a solvent partially containing alkyd resin within a range where the ratio of the total amount of white pigment and black pigment in terms of solid content to the total solid content in the coating agent for etching resist coating formation is 0.01 mass % or more and 95 mass % or less. Considering cost, it is more preferable that the ratio of the total amount of white pigment and black pigment in terms of solid content to the total solid content in the coating agent for etching resist coating formation be 0.01 mass % or more and 30 mass % or less. Publicly known black substances such as titanium oxide, iron phosphide, and carbon can be used as black pigment. Publicly known white substances such as zinc and titanium oxides can be used as white pigment.

The coating agent for etching resist coating formation of the present disclosure may contain other components as long as they do not impair the effects of the present disclosure. Other components include, for example, surfactants, rust inhibitors, lubricants, defoamers, antioxidants, leveling agents. These other components are added to further improve the performance of the etching resist coating and the uniform applicability of the coating agent for etching resist coating formation. The total mix proportion of these other components (in terms of the mix proportion in the dry coating) should be 95 mass % or less in terms of solid content with respect to the total solid content in the coating agent for etching resist coating formation from the viewpoint of maintaining sufficient etching resist coating performance.

(Inorganic Coating)

As mentioned above, the etching resist coating may be an inorganic coating that serves as a tension coating on the grain-oriented electrical steel sheet. For the coating composition, the insulating tension coating for grain-oriented electrical steel sheet described in the publicly known literature (e.g., WO2015/064472A1) can be used as a base, but since most of publicly known insulating tension coatings for grain-oriented electrical steel sheet are colorless and transparent, it is necessary to adjust the color tone separately. For example, an inorganic coating solution containing 20 mass % to 80 mass % phosphate (Mg phosphate, Al phosphate, Ca phosphate, etc.) in terms of solid content, 0 mass % to 10 mass % chromium oxide in terms of solid content, and 20 mass % to 50 mass % silica in terms of solid content can be used as a base, and the lightness L* value of the coating can be adjusted by adjusting the mix proportion of the pigment components such as black and white pigments as with the organic etching resist described above to form an insulating tension coating.

Groove Formation Method

In the groove forming method of this disclosure, the above-mentioned coating agent for etching resist coating formation is first applied to the surface or front and back surfaces of the metal strip to form an etching resist coating. The coating agent for etching resist coating formation can be applied by any publicly known method, but it is preferable to apply it uniformly to the surface or front and back surfaces of the metal strip. The coating agent for etching resist coating formation is applied, for example, using a gravure roll.

The etching resist coating is dried before the etching treatment described below. The etching resist coating is preferably dried before the laser irradiation described below. When drying the etching resist coating, the drying temperature is preferably 180° C. to 300° C. The drying method is not limited. For example, the etching resist coating can be dried by blowing hot blast.

Then, a laser with an output of less than 1.5 kW is irradiated on the etching resist coating while being scanned in a direction that intersects a rolling direction of the metal strip to remove the etching resist coating in the portion irradiated by the laser. As described above, in the present disclosure, by setting the lightness L* of the etching resist coating to 70 or less, the etching resist coating can be removed in a narrow width by a low-output laser with an output of less than 1.5 kW. Next, an etching treatment is applied to a portion of the metal strip below the removed portion of the etching resist coating to thereby form grooves on the portion of the metal strip surface below the removed portion of the etching resist coating. Etching may be performed by either chemical or electrolytic etching. For electrolytic etching, the electrolyte is preferably an aqueous solution of NaCl or KCl. After the etching treatment, the etching resist coating is removed from the metal strip surface to thereby obtain a metal strip with grooves. The etching resist coating is preferably removed with an alkali or organic solvent.

Laser

A laser beam is used to locally heat and vaporize the etching resist coating formed on the metal strip surface and remove it. Since the laser is usually irradiated on the metal strip with a width of 1 m or more, multiple laser irradiation devices are often used, but it is preferable to use three or less laser irradiation devices. More preferably, two or less devices are used. Using two or less laser irradiation devices can reduce the time required for equipment maintenance and improve productivity. On the other hand, by using more than one laser irradiation devices, the beam performance can be made more uniform over the entire laser-scanned region. Further, since the laser is scanned at high speed over the metal strip, the laser scanning is preferably performed by rotating and driving a polygon mirror. In addition, in order to prevent the locally removed etching resist coating from dirtying the laser beam path, it is preferable that the removed etching resist coating be collected by a dust collector by means of an air blast or other means. By not dirtying the laser beam path, the laser beam performance can be prevented from being altered by the locally removed etching resist coating.

Laser Output: Less than 1.5 kW

Generally, a higher laser output is advantageous in removing the etching resist coating, but an excessively high output may melt the metal strip at the laser-irradiated portion, resulting in non-uniform groove shape. Further, for example, in the case where a laser is irradiated on a primary recrystallized sheet of grain-oriented electrical steel sheet, there is a risk of introducing minute distortions in the steel substrate due to irradiation with a high-output laser. The minute distortions may be the driving force for crystal grain growth in orientations other than the Goss orientation during secondary recrystallization and may inhibit the sharpening to the Goss orientation. Therefore, it is preferable that the etching resist coating can be removed by a low-output laser. In this disclosure, the output of the laser can be reduced to less than 1.5 kW by setting the lightness L* of the etching resist coating to 70 or less. The laser output is preferably 1.4 kW or less, and more preferably 1.25 kW or less. No lower limit is placed on the laser output as long as the etching resist coating can be removed, but from the viewpoint of more suitably removing the etching resist coating, the laser output is preferably 0.3 kW or more, and more preferably 1.0 kW or more. The irradiation energy per unit scanning length of the laser is affected by the beam diameter and other factors, but is preferably 7.5 J/m or more for a beam diameter of 200 μm and 4.0 J/m or more for 100 μm. As described below, the appropriate scanning rate of the laser on the metal strip is preferably 111 m/s or more, in which case the irradiation energy per unit scanning length of the laser can be reduced than at a lower scanning rate.

The beam diameter in the direction orthogonal to the scanning direction of the laser on the metal strip surface is preferably 200 μm or less. By reducing the beam diameter in the direction orthogonal to the scanning direction of the laser on the metal strip surface to 200 μm or less, the removal width of the etching resist coating can be narrowed. This allows the groove formed after etching to be narrower, which in turn reduces the iron loss of the grain-oriented electrical steel sheet in which grooves are formed. The beam diameter in the direction orthogonal to the scanning direction of the laser on the metal strip surface is preferably 120 μm or less, and more preferably 80 μm or less. No limit is placed on the ratio of the major axis to the minor axis of the laser (major axis diameter/minor axis diameter), but the upper limit is set to 5.0 because an excessive increase in the ratio reduces the ability to remove the etching resist coating. The decrease in the ability to remove the etching resist coating as the major axis/minor axis ratio is increased is thought to be due to a decrease in the power density of the laser which is expressed as output/beam area. The beam diameter mentioned in this specification is the distance between two points corresponding to $1/e^2$ times the maximum value of the beam strength in the laser beam profile.

Preferably, used as the laser is a fiber laser. By using the fiber laser, a laser beam with a smaller diameter can be irradiated. As the fiber laser, it is preferable to use a fiber laser with a beam diameter in the direction orthogonal to the laser scanning direction of 200 μm or less. Preferably, used is a fiber laser with a diameter of 200 μm or less, or when the laser beam is elliptical, a fiber laser with a beam diameter in the direction orthogonal to the laser scanning direction of 200 μm or less and a beam diameter in the direction orthogonal to the laser scanning direction smaller than the beam diameter in the scanning direction.

Laser Scanning Rate: 111 m/s or More

A higher scanning rate of the laser on the metal strip is advantageous in increasing productivity. For example, for a metal strip with a width of 1200 mm, when the line speed is 50 mpm and three laser irradiation devices are used to form linear grooves with an interval of 3 mm in the rolling direction of the metal strip, the scanning rate of the laser is 111 m/s or more. On the other hand, in order to sufficiently heat the etching resist coating by laser irradiation and to suitably form desired grooves, the upper limit of the scanning rate of the laser is preferably 400 m/s when three laser irradiation devices are used and 600 m/s when two laser irradiation devices are used.

Scanning Angle of Laser on Metal Strip:

The laser used to remove the etching resist coating is irradiated while being scanned in a direction that intersects the rolling direction of the metal strip. The scanning angle of the laser is not limited as long as it is in a direction that intersects the rolling direction of the metal strip. When the groove forming method of this disclosure is applied to the manufacture of grain-oriented electrical steel sheet, the laser is preferably irradiated while being scanned so that the angle (0° to 90°) formed between the transverse direction of the metal strip and the laser scanning direction is 45° or less. This is because by setting the angle between the transverse direction of the metal strip and the laser scanning direction to 45° or less, iron loss can be particularly suitably reduced. The repetition interval in the rolling direction in the laser removal portion is preferably 1 mm or more and 30 mm or less. By setting the repetition interval in the laser removal portion in the rolling direction to 1 mm or more, the number of laser irradiation device required for resist removal and the maintenance time proportional to the number of device can be saved, thereby further increasing productivity. By setting the repetitive interval of the laser removal portion in the rolling direction to 30 mm or less, iron loss can be particularly suitably reduced.

When the groove forming method of this disclosure is used for the manufacture of grain-oriented electrical steel sheet, the groove width formed on the metal strip surface is preferably 200 μm or less from the viewpoint of further improving the magnetic properties of the grain-oriented electrical steel sheet after groove formation. The groove width formed on the metal strip surface is further preferably 100 μm or less.

Metal Strip

The type of metal strip on which grooves are formed by the groove formation method of this disclosure is not limited. In grain-oriented electrical steel sheet, its iron loss can be reduced by forming grooves on the steel sheet surface. As described above, the groove formation method of this disclosure can form narrow grooves on the steel sheet surface while reducing the thermal effects of laser irradiation on the steel sheet. Therefore, by forming grooves on the steel sheet surface using the groove formation method, the iron loss of grain-oriented electrical steel sheet can be effectively reduced.

Grain-Oriented Electrical Steel Sheet

In the grain-oriented electrical steel sheet, the surface roughness Ra in the transverse direction of the metal strip before etching resist application is preferably 0.5 μm or less. By setting the surface roughness Ra in the transverse direction of the metal strip to 0.5 μm or less, the iron loss of final grain-oriented electrical steel sheet can be further reduced. The surface roughness Ra in the transverse direction of the metal strip before etching resist application is preferably 0.4 μm or less, and further preferably 0.3 μm or less.

The final steel composition of the grain-oriented electrical steel sheet is not particularly limited and can be any publicly known steel composition, but it is preferable to contain C: 30 ppm or less, Si: 1% to 7%, P: 0.1% or less, Mn: 0.1% or less, S: less than 10 ppm, and N: 20 ppm or less. The C content is preferably less than 30 ppm because excessive C content will impair iron loss due to magnetic aging. The Si content is preferably 1% or more because Si increases specific resistance and reduce iron loss. Since P also increases specific resistance, P may be contained from the viewpoint of iron loss reduction. However, because a high P content may impair manufacturability, and lowers saturation magnetic flux density, the P content is preferably 0.1% or less. Mn and S are preferably kept within the above mentioned range because excessive content of Mn and S form precipitates such as MnS to thereby deteriorate iron loss. N is preferably minimized as much as possible because it precipitates silicon nitride and the like during stress relief annealing, thereby impairing iron loss. As for the other components, based on the conventional knowledge, there is no problem if they are added so that the crystal orientation after secondary recrystallization is sharpened in the Goss orientation, but in the case of forming a forsterite film, Cr that develops anchors should be as little as possible, and Cr content is preferably 0.1% or less. The elements Ti, Nb, V, Zr, and Ta are preferably set to 0.01% or less in total because they degrade iron loss by forming carbides and nitrides.

When assembling the iron core of a transformer, the outermost surface layer of the grain-oriented electrical steel sheet should be eventually coated with an insulating tension coating to improve insulation between the layers. The thickness of the resulting metal strip is preferably in the range of 0.10 mm to 0.35 mm. When manufacturing the grain-oriented electrical steel sheet, a non-heat-resistant type of magnetic domain refining treatment may be further applied by laser irradiation or other means.

Method for Manufacturing Grain-Oriented Electrical Steel Sheet

One example of the method for manufacturing a grain-oriented electrical steel sheet utilizing the groove forming method of the present disclosure comprises hot rolling a steel slab into a hot-rolled steel sheet, then, subjecting the hot-rolled steel sheet or a hot-rolled and annealed sheet obtained by applying hot-rolled sheet annealing to the hot-rolled steel sheet to cold rolling once, or twice or more with intermediate annealing performed therebetween to obtain a cold-rolled steel sheet, then subjecting the cold-rolled steel sheet to primary recrystallization annealing to obtain a primary recrystallized sheet, and then, subjecting the primary recrystallized sheet to secondary recrystallization annealing to obtain a secondary recrystallized sheet, wherein linear grooves are formed on a surface of the steel sheet at any stage after being subjected to hot rolling by the groove forming method mentioned above. The primary recrystallization annealing may also serve as decarburization to reduce carbon and nitriding to increase nitrogen in the steel sheet. Secondary recrystallization annealing here refers to annealing for selective abnormal grain growth of Goss-oriented grains. Secondary recrystallization annealing may also serve as a process for forming a forsterite film and purifying the elements in the steel.

Forming grooves on the steel sheet surface is performed at any stage after hot rolling. The metal strip to be grooved can be the hot-rolled steel sheet after hot rolling, the hot-rolled and annealed sheet obtained by subjecting the hot-rolled steel sheet to hot-rolled sheet annealing, the cold-rolled steel sheet after cold rolling when cold rolling is performed once, the cold-rolled steel sheet before or after intermediate annealing when cold rolling is performed twice or more with intermediate annealing performed therebetween, or the cold-rolled steel sheet after cold rolling is performed after intermediate annealing, the primary recrystallized sheet after primary recrystallization annealing, or the secondary recrystallized sheet after secondary recrystallization annealing. Since the groove may disappear if rolling is performed after groove formation, grooves should be formed on the cold-rolled steel sheet after cold rolling when cold rolling is performed once, the cold-rolled steel sheet after cold rolling after the last intermediate annealing when cold rolling is performed twice or more with intermediate annealing performed therebetween, the primary recrystallized sheet after primary recrystallization annealing, and the secondary recrystallized sheet after secondary recrystallization annealing. Groove formation may be performed at multiple stages after hot rolling.

The groove is a linear groove extending in a direction that intersects a rolling direction of the metal strip. When the metal strip is a grain-oriented electrical steel sheet, the angle of the linear groove to the transverse direction (TD) of the metal strip is preferably 45° or less from the viewpoint of subdividing the magnetic domain structure and reducing iron loss. Here, one groove does not necessarily have to extend the full width of the metal strip in the direction that intersects the rolling direction, and two or more laser irradiation device may be used to irradiate the laser so that multiple grooves continuously extend the full width of the metal strip. When manufacturing a grain-oriented electrical steel sheet, grooves are preferably formed repeatedly at periodic interval in the rolling direction of the metal strip in order to more effectively reduce iron loss. The shape of the linear grooves can be adjusted by the laser beam shape and etching conditions, and for grain-oriented electrical steel sheet, the groove preferably has a width of 30 μm or more and 200 μm or less, and a depth of 10 μm or more and 40 μm or less. The linear grooves are preferably formed periodically in the rolling direction of the metal strip. The periodic interval of the linear grooves is preferably 1 mm or more and 30 mm or less for grain-oriented electrical steel sheet. By setting the periodic interval of the linear grooves to 1 mm or more, the volume of the steel substrate in the grain-oriented electrical steel sheet can be more suitably secured and a more suitable magnetic flux density can be obtained. In addition, by setting the periodic interval of the linear grooves to 30 mm or less, a higher magnetic domain refining effect can be obtained.

EXAMPLES

Example 1

Manufacture of Grain-Oriented Electrical Steel Sheet with Linear Grooves

A steel slab containing 3.4% Si (C: 0.050%, Mn: 0.06%, P: 0.01%, S: 0.002%, Al: 0.014%, N: 70 ppm, Ti+Nb+V+Zr+Ta<0.001%) was hot rolled into hot-rolled steel sheets, then the hot-rolled steel sheets were subjected to hot-rolled sheet annealing at 1050° C. to obtain hot-rolled and annealed sheets, the hot-rolled and annealed sheets were cold rolled into cold-rolled steel sheets with a sheet thickness of 0.22 mm, the cold-rolled steel sheets were subjected to primary recrystallization annealing at 860° C. to obtain primary recrystallized sheets, and then the primary recrystallized sheets were subjected to secondary recrystallization annealing at a maximum temperature of 1200° C. to obtain secondary recrystallized sheets with a sheet thickness of 0.22 mm to obtain metal strips for grooving.

<Measurement of Surface Roughness Ra in Transverse Direction>

The surface roughness Ra of each of the metal strips in the transverse direction before etching resist coating formation was measured in accordance with JIS B 0031 (1994). The results are provided in Table 3.

Then, coating agents for etching resist coating formation having the compositions (in terms of solid content) listed in Table 2 were applied to the secondary recrystallized sheets on both sides so that the thickness per one side after baking was 2 μm, and baked at a temperature of 830° C. Titanium dioxide was used as the other component.

TABLE 2

| | Content (mass %) | | | | |
|---|---|---|---|---|---|
| L* | Magnesium phosphate | Chromium oxide | Silica | Carbon black | Other component (titanium oxide) |
| 90 | 52 | 5.5 | 37 | 0.0 | 5.5 |
| 65 | 55 | 5.5 | 39 | 0.5 | 0.0 |

<Measurement of Lightness L* of Etching Resist Coating>

The lightness L* in CIELAB color space (CIE 1976 L*a*b* color space) was measured for the formed etching resist coatings. The lightness L* was quantified by spectral reflectance measured with a spectrophotometer. The measurement results are listed in Table 3.

Next, a laser was irradiated to both the front and back surfaces of each of the steel sheets while being scanned in the transverse direction (TD) to periodically remove the etching resist coating in a linear pattern periodically at 5 mm intervals in the rolling direction.

<Measurement of Maximum Removal Width of Etching Resist Coating>

The maximum removal width of the etching resist coating was examined by observing the removal width of the etching resist coating on both sides of the steel sheet along the transverse direction (TD) of the steel sheet under an optical microscopy. The measurement results are listed in Table 3.

<Evaluation of Thermal Effects on Metal Strip Due to Laser Irradiation>

The presence or absence of thermal effects of laser irradiation on the metal strip was determined by the percentage reduction in the average of at least 15 measurement points of Vickers hardness of the steel substrate in the laser-irradiated portion after laser irradiation compared to the laser-unirradiated portion. When the Vickers hardness of the laser-irradiated portion was 1% or more lower than that of the laser-unirradiated portion, the thermal effect of laser irradiation was considered to be present. When the Vickers hardness of the laser-irradiated portion was not 1% or more lower than that of the laser-unirradiated portion, the thermal effect of laser irradiation was considered to be absent. Here, Vickers hardness measurement was performed using steel sheets, which were prepared separately from those to be etched, and was performed on the steel substrate after the etching resist coating was removed after laser irradiation. The evaluation results are listed in Table 3.

Then, electrolytic etching was performed on the steel sheet after the etching resist coating was locally removed. The electrolyte was NaCl, and the current density was adjusted in advance so that grooves with a desired depth were formed. After etching, the surface of the steel sheet was cleaned, and a coating of inorganic material with a thickness of 0.3 μm on one side was formed on the laser-irradiated surface at 300° C. to manufacture a grain-oriented electrical steel sheet with grooves formed on the surface. The laser irradiation conditions are listed in Table 3. Characterization of the grain-oriented electrical steel sheet with grooves formed on the surface was performed as follows. The results are listed in Table 3.

<Evaluation of Resist Removability>

The laser removability of the etching resist coating was evaluated by visually judging the appearance of the peeled line after laser irradiation and by the area ratio of the peeled area to the irradiated area of the laser-irradiated portion. Here, the laser-irradiated area was determined by multiplying the diameter of the laser in the direction orthogonal to the scanning direction by the distance the laser was scanned. A peeled area of the laser-irradiated portion of 95% or more was evaluated as "passed". The evaluation results are listed in Table 3.

(Criteria)

O: peeled area of laser-irradiated portion is 95% or more x: peeled area of laser-irradiated portion is less than 95%

<Measurement of Iron Loss $W_{17/50}$>

For iron loss, a single sheet magnetic test was conducted using 30 SST test pieces with a width of 100 mm and a length of 320 mm, and iron loss: $W_{17/50}$ (W/kg) was measured at a maximum magnetic flux density: 1.7 T and frequency: 50 kHz. When the iron loss $W_{17/50}$ is 0.710 W/kg or less, the magnetic properties were judged excellent, and when it is 0.700 W/kg or less, the magnetic properties were judged more excellent. The measurement results are listed in Table 3.

TABLE 3

| No | Resist (coating) L* | Laser (Fiber Laser) Output (kW) | Scanning rate (m/s) | Energy (J/m) | Diameter (μm) | Steel Sheet Resist removal rate (%) | Resist removability | Hardness reduction by laser irradiation (%) | Thermal effect by laser irradiation | Maximum value of resist removal width (μm) | Roughness in transverse direction Ra (μm) | Iron loss W17/50 (W/kg) | Remarks |
|---|---|---|---|---|---|---|---|---|---|---|---|---|---|
| 1 | 90 | 1.75 | 120 | 14.6 | 200 | 100 | ○ | 2.0 | present | 190 | 0.40 | 0.705 | Comparative Example |
| 2 | 90 | 1.25 | 120 | 10.4 | 200 | 86 | x | 1.4 | present | 160 | 0.40 | 0.723 | Comparative Example |
| 3 | 90 | 0.85 | 120 | 7.1 | 200 | 66 | x | 1.0 | present | 60 | 0.40 | 0.787 | Comparative Example |
| 4 | 65 | 1.75 | 120 | 14.6 | 200 | 100 | ○ | 1.0 | present | 190 | 0.40 | 0.701 | Comparative Example |
| 5 | 65 | 1.25 | 120 | 10.4 | 200 | 99 | ○ | 0.7 | absent | 190 | 0.40 | 0.694 | Example |

Underlined if outside the scope of the disclosure.

Example 2

Manufacture of Grain-Oriented Electrical Steel Sheet with Linear Grooves

For metal strips, a steel slab containing 3.4% Si (C: 0.050%, Mn: 0.06%, P: 0.01%, S: 0.002%, Al: 0.014%, N: 70 ppm, Ti+Nb+V+Zr+Ta<0.001%) was hot rolled into hot-rolled steel sheets, the hot-rolled steel sheets were subjected to hot-rolled sheet annealing at 1050° C. to obtain hot-rolled and annealed sheets, and then the hot-rolled and annealed sheets were cold rolled into cold-rolled steel sheets with a sheet thickness of 0.22 mm. The surface roughness Ra of each of the cold-rolled steel sheets (metal strip) in the transverse direction before etching resist coating formation was measured as in Example 1. The results are listed in Table 5.

Next, the coating agents for etching resist coating formation with the compositions (in terms of solid content) listed in Table 4 which mainly composed of a water-based alkyd resin were applied to the front and back surfaces of the cold-rolled steel sheets by gravure offset printing at a thickness of 2 μm, and then dried at 220° C. for 30 sec to form etching resist coatings. The lightness L* of the etching resist coatings was measured as in Example 1. The results are listed in Table 4.

TABLE 4

| L* | Content (mass %) Water-based alkyd resin | White pigment (zinc oxide-based) | Black pigment (iron oxide-based) | Other components |
|---|---|---|---|---|
| 77 | 8.0 | 85 | 0.5 | 6.5 |
| 60 | 32.5 | 50 | 0.5 | 17 |
| 51 | 36.5 | 20 | 0.5 | 43 |

TABLE 4-continued

| L* | Content (mass %) Water-based alkyd resin | White pigment (zinc oxide-based) | Black pigment (iron oxide-based) | Other components |
|---|---|---|---|---|
| 35 | 70.0 | 3 | 0.5 | 26.5 |
| 18 | 60.0 | 15 | 10.0 | 15 |

Then, a laser was irradiated on the surface of each of the steel sheets to remove the etching resist coating linearly with an interval of 3.3 mm in the rolling direction (RD). Then, electrolytic etching was performed on the steel sheet after the etching resist coating was locally removed. The electrolyte was NaCl, and the current density was adjusted in advance so that grooves with a desired depth were formed. After electrolytic etching, the etching resist coating remaining on the front and back surfaces of the steel sheet was removed with NaOH solution. The liquid temperature of the NaOH solution was maintained at 50° C. to 70° C. The steel sheet was then washed with water, followed by surface cleaning and grooves were formed on the surface. Table 5 provides the laser irradiation conditions. An elliptical beam was used only for condition No. 17, while an equiaxed (circular) beam was used for the other conditions. Only for No. 20, a $CO_2$ laser was used instead of a fiber laser. The cold-rolled steel sheets with linear grooves were then subjected to primary recrystallization annealing at 860° C. to make primary recrystallized sheets, and the primary recrystallized sheets were subjected to secondary recrystallization annealing at a maximum temperature of 1200° C. to make secondary recrystallized sheets. The secondary recrystallized sheets were then annealed at a maximum arrival temperature of 860° C. to flatten the sheet and form an insulating tension coating, resulting grain-oriented electrical steel sheets with a sheet thickness of 0.22 mm. Characterization of the grain-oriented electrical steel sheets was performed as in Example 1. The results are listed in Table 5.

TABLE 5

| | Laser | | | | | Steel Sheet | | | | | | | |
|---|---|---|---|---|---|---|---|---|---|---|---|---|---|
| No | Resist (coating) L* | Output (kW) | Scanning rate (m/s) | Energy (J/m) | Diameter (μm) | Resist removal rate (%) | Resist removability | Hardness reduction by laser irradiation (%) | Thermal effect by laser irradiation | Maximum value of resist removal width (μm) | Roughness in transverse direction Ra (μm) | Iron loss W17/50 (W/kg) | Remarks |
| 7 | 77 | 1.75 | 150 | 11.7 | 200 | 100 | ○ | 1.4 | present | 185 | 0.2 | 0.715 | Comparative Example |
| 8 | 77 | 1.75 | 150 | 11.7 | 400 | 82 | x | 0.5 | absent | 215 | 0.20 | 0.792 | Comparative Example |
| 9 | 77 | 1.75 | 120 | 14.6 | 200 | 100 | ○ | 1.5 | present | 185 | 0.20 | 0.718 | Comparative Example |
| 10 | 77 | 1.4 | 150 | 9.3 | 200 | 86 | x | 0.9 | absent | 130 | 0.20 | 0.744 | Comparative Example |
| 11 | 77 | 1.4 | 120 | 11.7 | 200 | 100 | ○ | 1.4 | present | 190 | 0.20 | 0.712 | Comparative Example |
| 12 | 60 | 1.4 | 300 | 4.7 | 100 | 99 | ○ | 0.9 | absent | 100 | 0.20 | 0.691 | Example |
| 13 | 51 | 1.4 | 150 | 9.3 | 200 | 99 | ○ | 0.5 | absent | 185 | 0.20 | 0.699 | Example |
| 14 | 51 | 0.75 | 150 | 5.0 | 100 | 97 | ○ | 0.7 | absent | 95 | 0.20 | 0.692 | Example |
| 15 | 51 | 0.45 | 150 | 3.0 | 60 | 95 | ○ | 0.9 | absent | 60 | 0.20 | 0.693 | Example |
| 16 | 51 | 0.50 | 150 | 3.3 | 60 | 96 | ○ | 1.1 | present | 60 | 0.55 | 0.706 | Example |
| 17 | 35 | 1.45 | 280 | 5.2 | Scanning direction: 250 direction orthogonal to scanning direction: 80 | 95 | ○ | 0.4 | absent | 80 | 0.10 | 0.690 | Example |
| 18 | 18 | 0.75 | 150 | 5.0 | 120 | 96 | ○ | 0.1 | absent | 115 | 0.10 | 0.684 | Example |
| 19 | 51 | 1.4 | 90 | 15.6 | 250 | 100 | ○ | 0.6 | absent | 210 | 0.20 | 0.708 | Example |
| 20 | 35 | 1.4 | 120 | 11.7 | 250 | 100 | ○ | 0.4 | absent | 220 | 0.20 | 0.702 | Example |

Underlined if outside the scope of the disclosure.

INDUSTRIAL APPLICABILITY

The grain-oriented electrical steel sheets manufactured using the groove forming method of the present disclosure exhibits good magnetic properties even after annealing such as stress relief annealing and can be applied to wound-type transformers. When the grain-oriented electrical steel sheets manufactured using the groove forming method is used in transformers, they are industrially useful because energy usage efficiency can be improved.

The invention claimed is:

1. A method for forming grooves comprising:

forming an etching resist coating on at least one surface of a metal strip, the etching resist coating having a lightness L* of 0 or more and 70 or less, then, irradiating a laser with an output of less than 1.5 kW on the etching resist coating while scanning the laser in a direction that intersects a rolling direction of the metal strip to remove a portion of the etching resist coating irradiated by the laser, and then, etching a portion of the metal strip below the removed portion of the etching resist coating to form grooves, wherein the lightness L* is a L* value in a CIELAB color space (CIE 1976 L*a*b* color space).

2. The method for forming grooves according to claim 1, wherein a removal width of the etching resist coating is 200 μm or less and a scanning rate of the laser is 111 m/s or more.

3. The method for forming grooves according to claim 1, wherein a beam diameter in a direction orthogonal to a scanning direction of the laser on the surface of the metal strip is 200 μm or less.

4. The method for forming grooves according to claim 1, wherein the laser is a fiber laser whose beam diameter in a direction orthogonal to a scanning direction of the laser is 200 μm or less.

5. The method for forming grooves according to claim 1, wherein a surface roughness Ra of the metal strip in a transverse direction before the etching resist coating is formed is 0.5 μm or less.

6. A method for manufacturing a grain-oriented electrical steel sheet, comprising hot rolling a steel slab into a hot-rolled steel sheet, then, subjecting the hot-rolled steel sheet or a hot-rolled and annealed sheet obtained by applying hot-rolled sheet annealing to the hot-rolled steel sheet to cold rolling once, or twice or more with intermediate annealing performed therebetween to obtain a cold-rolled steel sheet, then subjecting the cold-rolled steel sheet to primary recrystallization annealing to obtain a primary recrystallized sheet, and then, subjecting the primary recrystallized sheet to secondary recrystallization annealing to obtain a secondary recrystallized sheet, wherein grooves are formed on a surface of the steel sheet at any stage after being subjected to hot rolling by the method for forming grooves according to claim 1.

7. The method for forming grooves according to claim 2, wherein a beam diameter in a direction orthogonal to a scanning direction of the laser on the surface of the metal strip is 200 μm or less.

8. The method for forming grooves according to claim 2, wherein the laser is a fiber laser whose beam diameter in a direction orthogonal to a scanning direction of the laser is 200 μm or less.

9. The method for forming grooves according to claim 2, wherein a surface roughness Ra of the metal strip in a transverse direction before the etching resist coating is formed is 0.5 μm or less.

10. The method for forming grooves according to claim 3, wherein a surface roughness Ra of the metal strip in a transverse direction before the etching resist coating is formed is 0.5 μm or less.

11. The method for forming grooves according to claim 4, wherein a surface roughness Ra of the metal strip in a transverse direction before the etching resist coating is formed is 0.5 μm or less.

12. The method for forming grooves according to claim 7, wherein a surface roughness Ra of the metal strip in a transverse direction before the etching resist coating is formed is 0.5 μm or less.

13. The method for forming grooves according to claim 8, wherein a surface roughness Ra of the metal strip in a transverse direction before the etching resist coating is formed is 0.5 μm or less.

14. A method for manufacturing a grain-oriented electrical steel sheet, comprising hot rolling a steel slab into a hot-rolled steel sheet, then, subjecting the hot-rolled steel sheet or a hot-rolled and annealed sheet obtained by applying hot-rolled sheet annealing to the hot-rolled steel sheet to cold rolling once, or twice or more with intermediate annealing performed therebetween to obtain a cold-rolled steel sheet, then subjecting the cold-rolled steel sheet to primary recrystallization annealing to obtain a primary recrystallized sheet, and then, subjecting the primary recrystallized sheet to secondary recrystallization annealing to obtain a secondary recrystallized sheet, wherein grooves are formed on a surface of the steel sheet at any stage after being subjected to hot rolling by the method for forming grooves according to claim 2.

15. A method for manufacturing a grain-oriented electrical steel sheet, comprising hot rolling a steel slab into a hot-rolled steel sheet, then, subjecting the hot-rolled steel sheet or a hot-rolled and annealed sheet obtained by applying hot-rolled sheet annealing to the hot-rolled steel sheet to cold rolling once, or twice or more with intermediate annealing performed therebetween to obtain a cold-rolled steel sheet, then subjecting the cold-rolled steel sheet to primary recrystallization annealing to obtain a primary recrystallized sheet, and then, subjecting the primary recrystallized sheet to secondary recrystallization annealing to obtain a secondary recrystallized sheet, wherein grooves are formed on a surface of the steel sheet at any stage after being subjected to hot rolling by the method for forming grooves according to claim 3.

16. A method for manufacturing a grain-oriented electrical steel sheet, comprising hot rolling a steel slab into a hot-rolled steel sheet, then, subjecting the hot-rolled steel sheet or a hot-rolled and annealed sheet obtained by applying hot-rolled sheet annealing to the hot-rolled steel sheet to cold rolling once, or twice or more with intermediate annealing performed therebetween to obtain a cold-rolled steel sheet, then subjecting the cold-rolled steel sheet to primary recrystallization annealing to obtain a primary recrystallized sheet, and then, subjecting the primary recrystallized sheet to secondary recrystallization annealing to obtain a secondary recrystallized sheet, wherein grooves are formed on a surface of the steel sheet at any stage after being subjected to hot rolling by the method for forming grooves according to claim 4.

17. The method for forming grooves according to claim 1, wherein the output of the laser is 0.3 kW or more and less than 1.5 kW.

18. The method for forming grooves according to claim 1, wherein the output of the laser is 0.3 kW or more and 1.4 kW or less.

19. The method for forming grooves according to claim 1, wherein the output of the laser is 0.3 kW or more and 1.25 kW or less.

20. The method for forming grooves according to claim 1, wherein the laser heats and vaporizes the etching resist coating formed on the metal strip surface to remove the portion of the etching resist coating irradiated by the laser.

* * * * *